US011976819B2

(12) United States Patent
Park et al.

(10) Patent No.: US 11,976,819 B2
(45) Date of Patent: May 7, 2024

(54) FLUE PIPE SEPARATION SENSING APPARATUS AND BOILER INCLUDING THE SAME

(71) Applicant: KYUNGDONG NAVIEN CO., LTD., Pyeongtaek-si (KR)

(72) Inventors: Jun Kyu Park, Seoul (KR); Duck Sik Park, Seoul (KR)

(73) Assignee: Kyungdong Navien Co., Ltd., Pyeongtaek-si (KR)

( * ) Notice: Subject to any disclaimer, the term of this patent is extended or adjusted under 35 U.S.C. 154(b) by 233 days.

(21) Appl. No.: 17/564,669

(22) Filed: Dec. 29, 2021

(65) Prior Publication Data

US 2023/0204209 A1 Jun. 29, 2023

(51) Int. Cl.
*F23J 13/04* (2006.01)
*F23J 13/02* (2006.01)

(52) U.S. Cl.
CPC ..... *F23J 13/04* (2013.01); *F23J 13/02* (2013.01); *F23J 2213/203* (2013.01); *F23J 2213/70* (2013.01)

(58) Field of Classification Search
CPC ..... F23J 13/04; F23J 13/02; F23J 2213/203; F23J 2213/70
See application file for complete search history.

(56) References Cited

U.S. PATENT DOCUMENTS

2006/0140754 A1* 6/2006 Tanioka ..... F01D 11/24 415/173.1
2009/0250125 A1* 10/2009 Howitt ..... E03F 7/00 137/551
2011/0292384 A1* 12/2011 Ramos ..... G01M 3/047 356/237.1
2016/0363348 A1* 12/2016 Okamoto ..... F23N 1/00
2017/0254216 A1* 9/2017 Adibhatla ..... F02C 6/08

* cited by examiner

*Primary Examiner* — David J Laux
(74) *Attorney, Agent, or Firm* — ALG Intellectual Property, LLC

(57) ABSTRACT

Disclosed are a flue pipe separation sensing apparatus and a boiler including the same. The flue pipe separation sensing apparatus of a boiler for sensing separation of an exhaust flue pipe that is fitted with and coupled to an exhaust adapter provided in an exhaust opening of a boiler body includes a sensing member located on an outer side of the exhaust flue pipe in a state, in which the exhaust flue pipe is coupled to the exhaust adapter, and that passes through the exhaust adapter by an elastic force and proceed into an interior of the exhaust adapter to sense the separation of the exhaust flue pipe when the exhaust flue pipe is separated from the exhaust adapter.

15 Claims, 8 Drawing Sheets

FLUE PIPE SEPARATION SENSING APPARATUS AND BOILER INCLUDING THE SAME

TECHNICAL FIELD

The present disclosure relates to a flue pipe separation sensing apparatus and a boiler including the same, and more particularly, to a flue pipe separation sensing apparatus that senses separation of an exhaust flue pipe of a boiler from an exhaust adapter, and a boiler including the same.

BACKGROUND

Because exhaust gas burned in and discharged from a boiler contains toxic materials, such as carbon monoxide, which are harmful to human bodies, a flue pipe is connected to an exhaust opening of the boiler to form a passage, through which the exhaust gas is discharged to an exterior such that the exhaust gas is discharged to the exterior.

Generally, in the boiler, a flue pipe and a smoke pipe are connected to each other through interference-fitting, or by using a fixing member, such as a separate band clamp or a coupling band. The smoke pipe may be separated due to an installation condition, lapse of a use period, or a defect of a component thereof. However, because the conventional boiler has no separate safety device when the flue pipe is separated, the exhaust gas is introduced into an interior and a mortality event occurs.

SUMMARY

The present disclosure has been made to solve the above-mentioned problems occurring in the prior art while advantages achieved by the prior art are maintained intact.

An aspect of the present disclosure provides a flue pipe separation sensing apparatus that prevents a safety accident due to exhaust gas leaked between an exhaust flue pipe and an exhaust adapter in advance by detecting separation of the exhaust flue pipe from the exhaust adapter, and thus enhances a reliability of a boiler product, and a boiler.

Another aspect of the present disclosure provides a flue pipe separation sensing apparatus that detects separation of an exhaust flue pipe more accurately, and a boiler.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, a flue pipe separation sensing apparatus of a boiler for sensing separation of an exhaust flue pipe that is fitted with and coupled to an exhaust adapter provided in an exhaust opening of a boiler body includes a sensing member located on an outer side of the exhaust flue pipe in a state, in which the exhaust flue pipe is coupled to the exhaust adapter, and that passes through the exhaust adapter by an elastic force and proceed into an interior of the exhaust adapter to sense the separation of the exhaust flue pipe when the exhaust flue pipe is separated from the exhaust adapter.

The exhaust adapter may include a through-hole that passes through a part, to which the exhaust flue pipe is coupled, and the sensing member may include a sensing switch brought into any one of a contact-off state and a contact-on state in the state, in which the exhaust flue pipe is coupled to the exhaust adapter, and switched from the any one of the contact-off state and the contact-on state to the other of the contact-off state and the contact-on state to detect the separation of the exhaust flue pipe when the exhaust flue pipe is separated from the exhaust adapter.

The sensing switch may include a switch case, a switch plate coupled to an outer surface of the switch case, and one end of which is hinge-coupled to the switch case and an opposite end of which is a free end, wherein the free end may be configured to be inserted into the interior of the exhaust adapter through the through-hole, and a press part configured such that at least a portion thereof is inserted into and extracted from the switch case, and the press part may bring a contact point into any one of an off state and an on state by pressing the switch plate when the exhaust flue pipe is coupled to the exhaust adapter.

The press part may protrude to an outside of the switch case by a restoring force of an elastic member provided in an interior of the switch case to switch the contact point to the other of the off state and the on state by pressing the switch plate toward the interior of the exhaust adapter when the exhaust flue pipe is separated from the exhaust adapter.

The one end of the switch plate may be hinge-coupled to a hinge part provided in the switch case, and the opposite end of the switch plate may extend downwards from the hinge part.

The switch plate may include a first inclined part extending from the one end in a direction that faces the opposite direction, and inclined toward an inside of the exhaust adapter as it goes toward the opposite side, and a second inclined part extending from the first inclined part in a direction that faces the opposite direction, and inclined toward the inside of the exhaust adapter as it goes toward the opposite side, and the first inclined part may be inclined at a first angle with respect to a vertical reference surface that is perpendicular to a ground surface, and the second inclined part may be inclined at a second angle that is larger than the first angle with respect to the vertical reference surface.

A surface of the switch case, which faces the inside of the exhaust adapter and on which the switch plate is mounted, may be inclined in a direction that becomes farther away from the exhaust adapter as it goes upwards when the switch case is mounted on the exhaust adapter.

The flue pipe separation sensing apparatus may further include a housing coupled to an outside of the exhaust adapter and that accommodates the sensing switch.

The housing may include a housing body coupled to the exhaust adapter and having an interior space, in which the sensing switch is accommodated, a cover member coupled to an opening provided in the housing body and covering the interior space, a first fastening member coupling the housing body and the exhaust adapter, and a second fastening member coupling the housing body and the cover member.

The sensing switch further may include a switch packing member that surrounds a circumference of the switch case to seal a gap between the switch case and the exhaust adapter or a gap between the switch case and the housing.

The housing may further include a first housing packing member provided along a circumference of the through-hole and interposed between the housing body and the exhaust adapter to seal a gap between the housing body and the exhaust adapter.

A connection hole, through which a wiring line electrically connected to the sensing switch passes, may pass through the housing body, and the housing may further include a second housing packing provided along a circumference of the connection hole and that seals a gap between the housing body and the boiler body.

According to another aspect of the present disclosure, a boiler may include a boiler body, an exhaust adapter provided in an exhaust opening opened in the boiler body and that discharges exhaust gas in an interior of the boiler body to an outside, an exhaust flue pipe coupled to the exhaust adapter to be communicated with an interior of the exhaust adapter, and one end of which is inserted into the exhaust adapter, and a sensing apparatus provided in the exhaust adapter, and that senses separation of the exhaust flue pipe from the exhaust adapter, and the sensing apparatus includes a sensing member located on an outer side of the exhaust flue pipe in a state, in which the exhaust flue pipe is coupled to the exhaust adapter, and that passes through the exhaust adapter by an elastic force and proceed into the interior of the exhaust adapter to sense the separation of the exhaust flue pipe when the exhaust flue pipe is separated from the exhaust adapter.

The exhaust adapter may include a through-hole that passes through a part, to which the exhaust flue pipe is coupled, and the sensing member may include a sensing switch brought into any one of a contact-off state and a contact-on state in the state, in which the exhaust flue pipe is coupled to the exhaust adapter, and switched from the any one of the contact-off state and the contact-on state to the other of the contact-off state and the contact-on state to detect the separation of the exhaust flue pipe when the exhaust flue pipe is separated from the exhaust adapter.

The exhaust adapter may include a switch mounting part including a hollow communicated with the through-hole, and extending to an outside of the exhaust adapter, and a portion of a housing included in the sensing apparatus is inserted into the hollow of the switch mounting part.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Hereinafter, preferred embodiments of the present disclosure will be described in detail with reference to the accompanying drawings.

First, the embodiments described below are embodiments that are suitable for understanding of technical features of a flue pipe separation sensing apparatus of a boiler and a boiler including the same according to the present disclosure. However, the present disclosure is not limited to the embodiment described below or the technical features of the present disclosure are not limited by the described embodiments, and the present disclosure may be variously modified without departing from the technical scope of the present disclosure.

Figure 1:
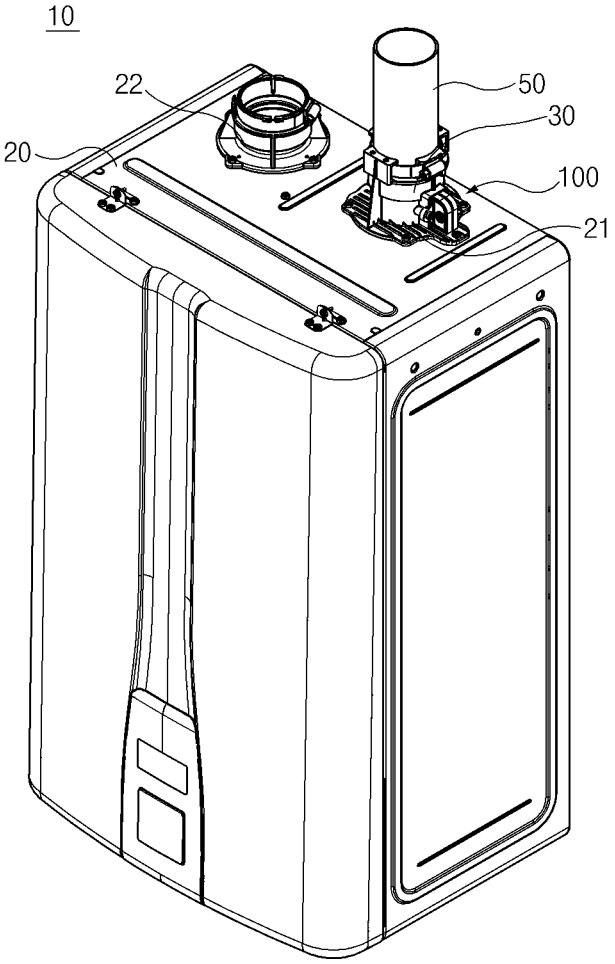
FIG. 1 is a perspective view of a boiler according to an embodiment of the present disclosure.
Figure 2:
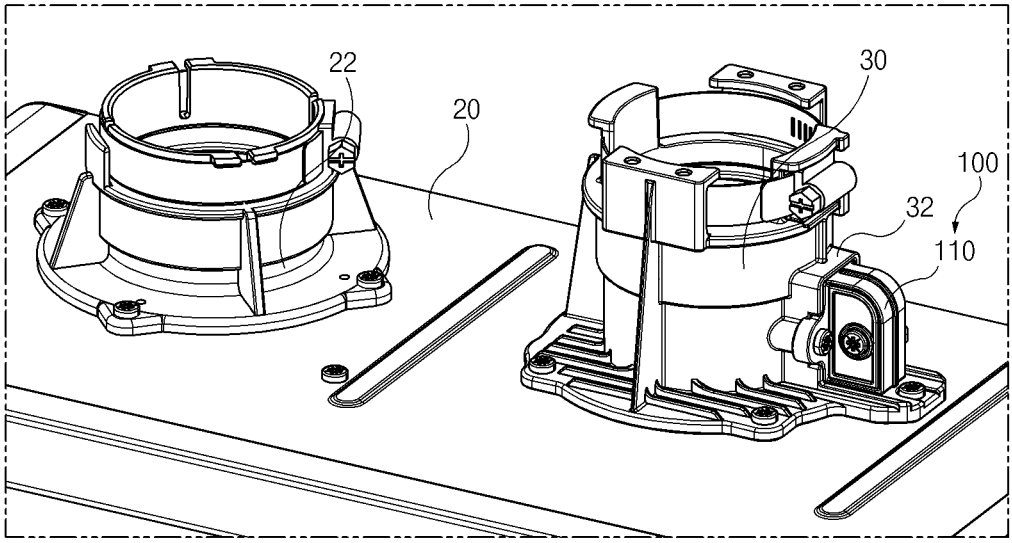
FIG. 2 is a perspective view illustrating a flue pipe separation sensing apparatus of a boiler according to an embodiment of the present disclosure.
Figure 3:
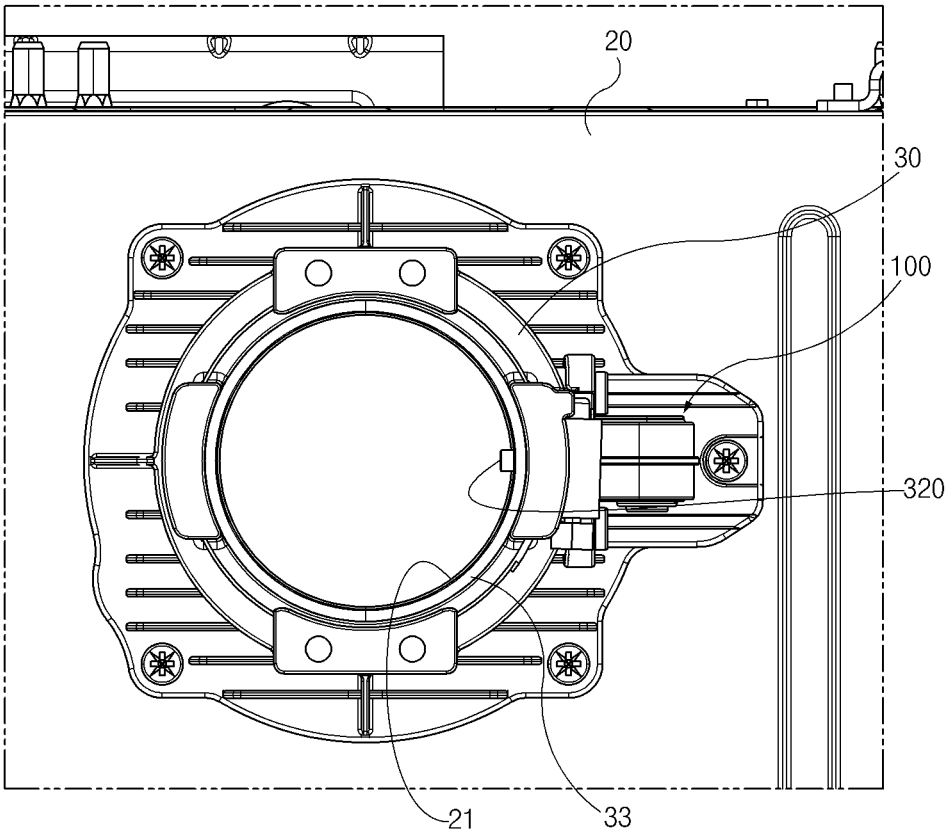
FIG. 3 is a top view of a boiler, on which a flue pipe separation sensing apparatus of the boiler is mounted, according to an embodiment of the present disclosure.
Figure 4:
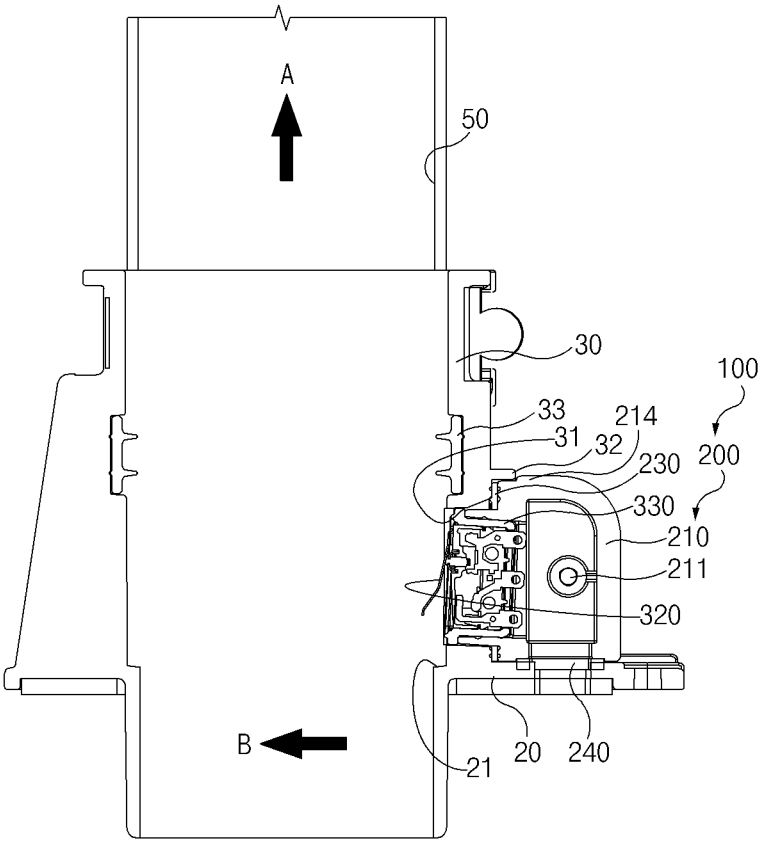
FIG. 4 is a cross-sectional view illustrating a state, in which a flue pipe separation sensing apparatus of a boiler is mounted on an exhaust adapter, according to an embodiment of the present disclosure.
Figure 5:
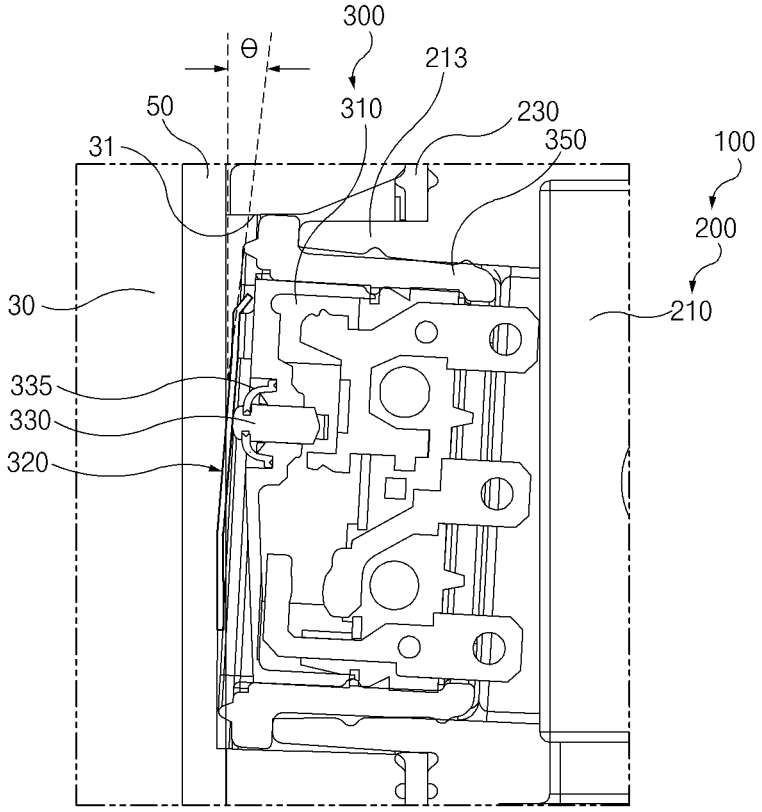
FIG. 5 is an enlarged cross-sectional view illustrating a flue pipe separation sensing apparatus of a boiler according to an embodiment of the present disclosure, and illustrates a state, in which an exhaust flue pipe and an exhaust adapter are coupled to each other.
Figure 6:
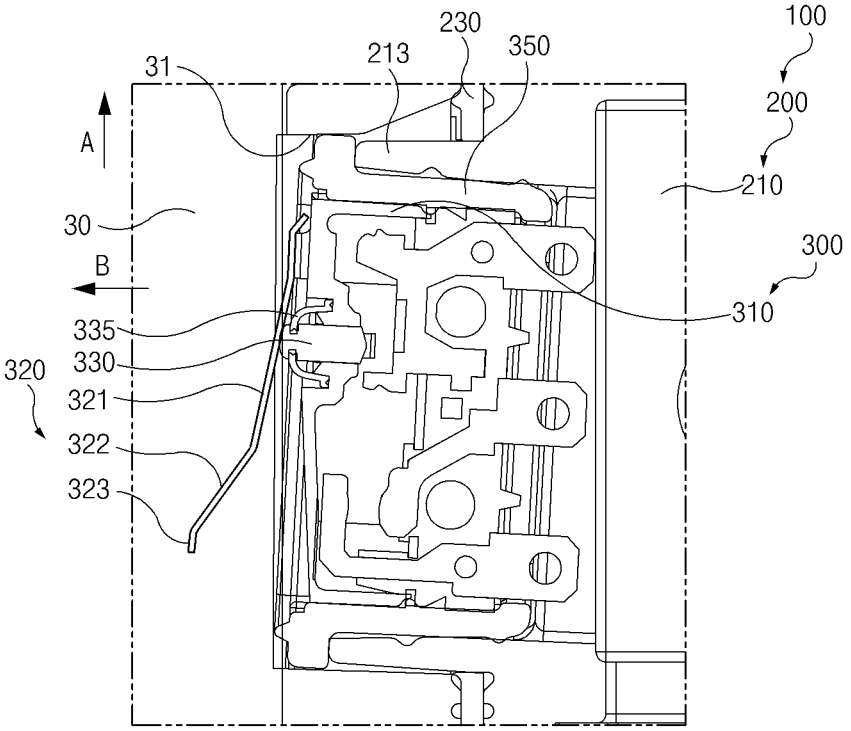
FIG. 6 is an enlarged cross-sectional view illustrating a flue pipe separation sensing apparatus of a boiler according to an embodiment of the present disclosure, and illustrates a state, in which an exhaust flue pipe and an exhaust adapter are separated from each other.
Figure 7:
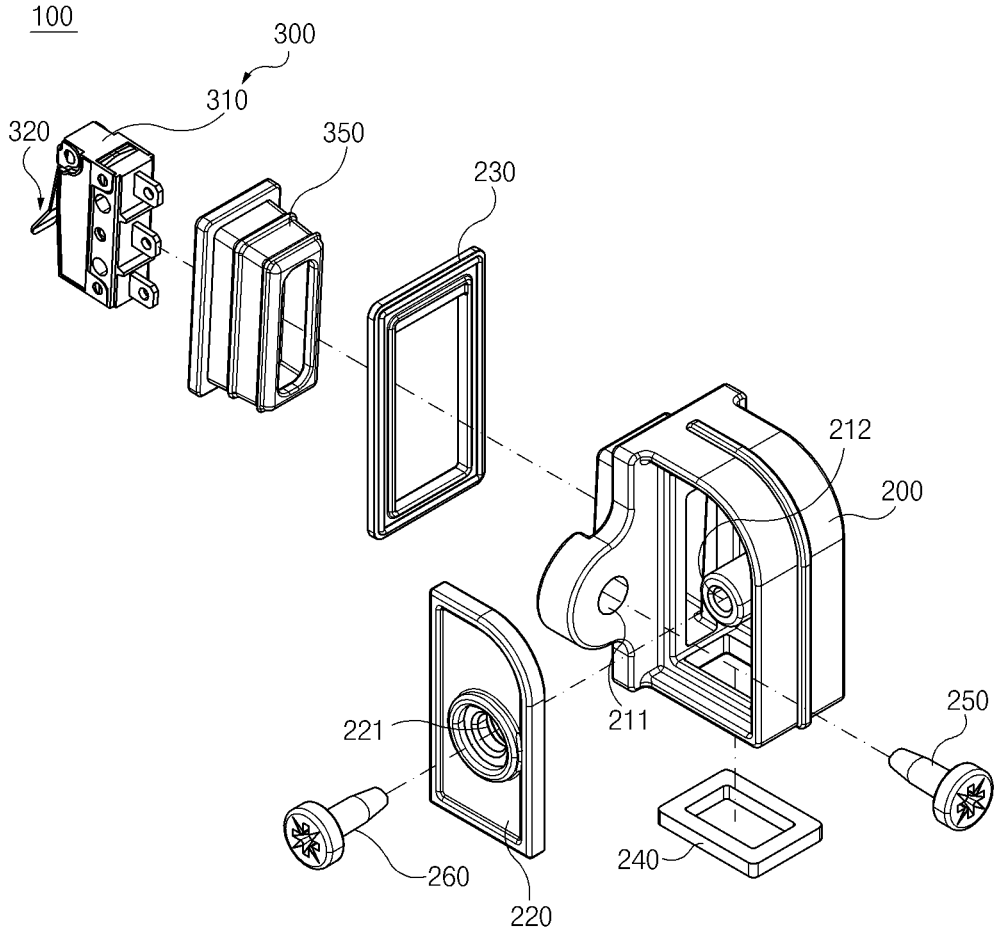
FIG. 7 is an exploded perspective view illustrating a flue pipe separation sensing apparatus of a boiler according to an embodiment of the present disclosure.
Figure 8:
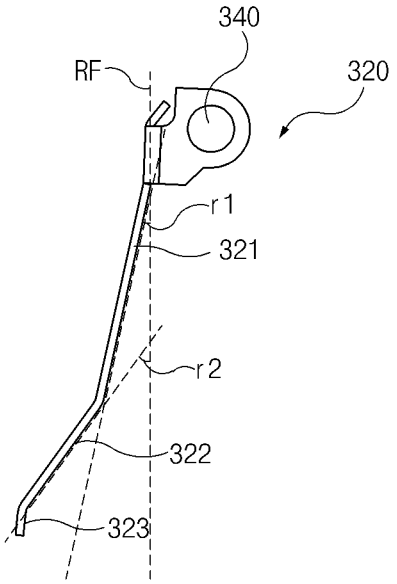
FIG. 8 is a view illustrating a switch plate and a hinge part of a sensing switch according to an embodiment of the present disclosure.

FIG. 1 is a perspective view of a boiler according to an embodiment of the present disclosure. FIG. 2 is a perspective view illustrating a flue pipe separation sensing apparatus of a boiler according to an embodiment of the present disclosure. FIG. 3 is a top view of a boiler, on which a flue pipe separation sensing apparatus of the boiler is mounted, according to an embodiment of the present disclosure. FIG. 4 is a cross-sectional view illustrating a state, in which a flue pipe separation sensing apparatus of a boiler is mounted on an exhaust adapter, according to an embodiment of the present disclosure. FIG. 5 is an enlarged cross-sectional view illustrating a flue pipe separation sensing apparatus of a boiler according to an embodiment of the present disclosure, and illustrates a state, in which an exhaust flue pipe and an exhaust adapter are coupled to each other. FIG. 6 is an enlarged cross-sectional view illustrating a flue pipe separation sensing apparatus of a boiler according to an embodiment of the present disclosure, and illustrates a state, in which an exhaust flue pipe and an exhaust adapter are separated from each other. FIG. 7 is an exploded perspective view illustrating a flue pipe separation sensing apparatus of a boiler according to an embodiment of the present disclosure. FIG. 8 is a view illustrating a switch plate and a hinge part of a sensing switch according to an embodiment of the present disclosure.

Referring to FIGS. 1 to 3, a boiler 10 according to an embodiment of the present disclosure includes a boiler body 20, an exhaust adapter 30, an exhaust flue pipe 50, and a sensing apparatus 100.

A space, in which components are inserted, may be formed in the boiler body 20, and an air supply opening 22 and an exhaust opening 21 may be formed to be opened.

The exhaust adapter 30 is provided in the exhaust opening 21, and is configured to discharge exhaust gas in an interior of the boiler body 20 to an outside.

The exhaust flue pipe 50 is coupled to the exhaust adapter 30 to be communicated with an interior of the exhaust adapter 30, and one end of the exhaust flue pipe 50 is inserted into the exhaust adapter 30. The exhaust adapter 30 and the exhaust flue pipe 50 may be tubular, and may be coupled to each other to be communicated with each other. Exhaust gas generated in the boiler body 20 may flow to the exhaust adapter 30 and the exhaust flue pipe 50 and be discharged to an outside. The exhaust flue pipe 50 and the exhaust adapter 30 may be coupled to each other through interference-fitting or by using a separate fixing member. An O-ring 33 may be mounted between the exhaust flue pipe 50 and the exhaust adapter 30 to maintain a sealing state.

The sensing apparatus 100 is provided in the exhaust adapter 30 to sensor separation of the exhaust flue pipe 50 from the exhaust adapter 30. In detail, the exhaust flue pipe 50 may be separated from the exhaust adapter 30 as the boiler 10 is used, and the sensing apparatus 100 may be provided adjacent to the exhaust adapter 30 to sense separation of the exhaust flue pipe 50.

In more detail, the sensing apparatus 100 includes a sensing member. The sensing member is located on an outer side of the exhaust flue pipe 50 in a state, in which the exhaust flue pipe 50 is coupled to the exhaust adapter 30, and passes through the exhaust adapter 30 by an elastic force and proceeds into an interior of the exhaust adapter 30 to sense the separation of the exhaust flue pipe 50 when the exhaust flue pipe 50 is separated from the exhaust adapter 30.

The exhaust adapter 30 may include a through-hole 31 that passes through a part, to which the exhaust flue pipe 50 is coupled. The sensing member may be blocked by the exhaust flue pipe 50 not to pass through the through-hole 31 in a state, in which the exhaust flue pipe 50 is coupled to the exhaust adapter 30, and may pass through the through-hole 31 of the exhaust adapter 30 by an elastic force to proceed into the interior of the exhaust adapter 30 when the exhaust flue pipe 50 is separated from the exhaust adapter 30.

The exhaust adapter 30 may include a switch mounting part 32 that includes a hollow communicated with the through-hole 31 and extends to an outside of the exhaust adapter 30. A portion of the sensing member may be inserted into the switch mounting part 32, and accordingly, a coupling force of the exhaust adapter 30 and the sensing member is enhanced and leakage of gas through the through-hole 31 may be minimized. A portion of a housing 200 of the sensing member, which will be described blow, may be inserted into the hollow of the switch mounting part 32.

The sensing member may proceed to the interior of the exhaust adapter 30 to detect separation of the exhaust flue pipe 50 through a change in temperature, an on/off operation of a switch, and the like.

In this way, the present disclosure may prevent a safety accident due to the exhaust gas leaked between the exhaust flue pipe 50 and the exhaust adapter 30 in advance by detecting separation of the exhaust flue pipe 50 by the flue pipe separation sensing apparatus 100. Accordingly, a reliability of the boiler 10 product may be enhanced.

Furthermore, the sensing member according to the present disclosure proceeds into the interior of the exhaust adapter 30 immediately after the exhaust flue pipe 50 is separated to detect separation of the exhaust flue pipe 50, and thus may detect the separation of the exhaust flue pipe 50 more accurately.

Hereinafter, the sensing member according to the embodiment of the present disclosure will be described in detail with reference to FIGS. 1 to 8.

Referring to FIGS. 1 to 8, according to the embodiment of the present disclosure, the sensing member may include a sensing switch 300.

The sensing switch 300 may be brought into any one of a contact-off state and a contact-on state in the state, in which the exhaust flue pipe 50 is coupled to the exhaust adapter, and may be switched from the any one of the contact-off state and the contact-on state to the other of the contact-off state and the contact-on state to detect separation of the exhaust flue pipe 50 when the exhaust flue pipe 50 is separated from the exhaust adapter 30. For example, the sensing switch 300 may be a micro switch, but the present disclosure is not limited thereto.

In detail, the sensing switch 300 may include a switch case 310, a switch plate 320, and a press part 330. Furthermore, the flue pipe separation sensing apparatus 100 of the boiler 10 according to the embodiment of the present disclosure may further include the housing 200.

The housing 200 may be coupled to an outside of the exhaust adapter 30, and the sensing switch 300 may be accommodated therein. The housing 200 may be mounted at a location, at which the sensing switch 300 passes through the through-hole 31, and may be coupled to the exhaust adapter 30 or the boiler body 20. The housing 200 may function to mount the sensing switch 300 on the exhaust adapter 30, and seal the through-hole 31 while protecting the sensing switch 300.

The housing 200 may be coupled to the exhaust adapter 30 or the boiler body 20 to be attached and detached easily through bolting and the like. For example, the switch mounting part 32 may be formed in the exhaust adapter 30, and a portion of the housing 200 may be inserted into the hollow of the switch mounting part 32.

In more detail, the housing 200 may include a housing body 210, a cover member 220, a first fastening member 250, and a second fastening member 260.

The housing body 210 may be coupled to the exhaust adapter 30, and may include an interior space, in which the sensing switch 300 may be accommodated. Furthermore, the cover member 220 may be coupled to the opening included in the housing body 210 to cover the interior space.

In detail, the housing body 210, as described above, may be fitted with the through-hole 31 or the switch mounting part 32. For example, an outer surface of the housing body 210 of a portion coupled to the exhaust adapter 30 may be stepped. As an example, the outer surface of the housing body 210 may include a first insertion part 213 inserted into the through-hole 31, and a second insertion part 214 stepped from the first insertion part 213 and inserted into to the switch mounting part 32. Here, a size of an outer surface of the first insertion part 213 may correspond to a size of the through-hole 31, and a size of an outer surface of the second insertion part 214 may correspond to a size of the switch mounting part 32.

In this way, because the housing body 210 is stepped at a coupling part to the exhaust adapter 30, it may be inserted into the through-hole 31 and switch mounting part 32 in two steps. Accordingly, the housing 200 according to the present disclosure may minimize the exhaust gas flowing through the interior of the exhaust adapter 30 and the condensate generated by the exhaust flue pipe 50 from being leaked to the outside.

Meanwhile, an opening may be formed at a side of the housing body 210, and the cover member 220 may be coupled to the housing body 210 to cover the opening. Furthermore, a connection hole, through which a wiring line electrically connected to the sensing switch 300 passes to an outside, may pass through the housing body 210. As an example, the present disclosure may further include a wire harness that electrically connects the sensing switch 300 and a control device provided in an interior of the boiler body 20, and a wiring line of the wire harness may pass through the connection hole. The boiler body 20 may have a hole corresponding to the connection hole.

Meanwhile, the first fastening member 250 may fasten the housing body 210 and the exhaust adapter 30. A first fastening hole 211, through which the first fastening member 250 passes, may be formed in the housing body 210, and a coupling hole corresponding to the first fastening hole 211 may be formed in the exhaust adapter 30.

The second fastening member 260 may fasten the housing body 210 and the cover member 220. A second fastening hole 212, through which the second fastening member 260 passes, may be formed in the housing body 210, and a cover coupling hole 221 corresponding to the second fastening hole 212 may be formed in the cover member 220.

The switch case 310 may be accommodated in the interior space of the housing 200. The switch case 310 may include a fine contact gap and a snap operation mechanism in an interior thereof, and the snap operation mechanism and a contact mechanism may be operated by an external force to bring a contact point into any one of an off state and an on state.

Meanwhile, the switch plate 320 may be coupled to an outer surface of the switch case 310, one end thereof may be hinge-coupled to the switch case 310 and an opposite end thereof may be a free end, and the free end thereof may be inserted into the interior of the exhaust adapter 30 through the through-hole 31. The switch case 310 may further include a hinge part 340, to which the switch plate 320 is hinge-coupled, and a case hole, through which the press part 330 may be inserted and extracted.

The press part 330 may be configured such that at least a portion thereof is inserted into and extracted from the switch case 310. Furthermore, the press part 330 may press the switch plate 320 to bring the contact point into any one of the off state and the on state when the exhaust flue pipe 50 is coupled to the exhaust adapter 30 (see FIG. 5).

Furthermore, the press part 330 may protrude to an outside of the switch case 310 by a restoring force of an elastic member 335 provided in an interior of the switch case 310 to switch the contact point to the other of the off state and the on state by pressing the switch plate 320 toward the interior of the exhaust adapter 30 when the exhaust flue pipe 50 is separated from the exhaust adapter 30 (see FIGS. 4 and 6). For example, the press part 330 may switch the contact point from the off state to the on state when the exhaust flue pipe 50 is separated, but the on/off state according to the movement of the press part 330 is not limited thereto as well as the contact state may be switched.

In detail, referring to FIG. 5, the housing 200 may be installed adjacent to the through-hole 31 of the exhaust adapter 30, and the sensing switch 300 may be accommodated in the housing 200. The switch plate 320 may pressed toward the case by the exhaust flue pipe 50. Furthermore, the press part 330 may be pressed by the switch plate 320 to bring the contact point into any one (for example, the off state) of the off state and the on state.

Thereafter, as illustrated in FIGS. 4 and 6, when the exhaust flue pipe 50 is separated from the exhaust adapter 30 (refer to direction A), the press part 330 may protrude to the outside of the case by a restoring force of the elastic member 335 provided in the interior of the case. Then, the switch plate 320 may be pressed toward the interior of the exhaust adapter 30 by the press part 330 (refer to direction B) whereby the free end may pass through the through-hole 31 and be inserted into the interior of the exhaust adapter 30. Accordingly, the contact point in the interior of the case may be switched from any one (for example, the off state) of the off state and the on state to the other (for example, the on state) thereof.

In this way, the press part 330 may be pressed in the state, in which the exhaust flue pipe 50 is not separated, and the press part 330 may protrude to the outside of the case by the elastic force when the exhaust flue pipe 50 is separated. The flue pipe separation sensing apparatus 100 according to the present disclosure may sense the separation of the exhaust flue pipe 50 by switching the contact point of the sensing switch 300 from the any one to the other.

Meanwhile, referring to FIG. 5, a surface of the switch case 310, which faces the inside of the exhaust adapter 30 and on which the switch plate 320 is mounted, is inclined in a direction that becomes farther away from the exhaust adapter 30 as it goes upwards when the switch case 310 is mounted on the exhaust adapter 30.

In detail, the surface of the switch case 310, which faces the inside of the exhaust adapter 30, may be inclined at a specific angle θ with respect to a surface that is perpendicular to the ground surface. Accordingly, an upper part of the switch case 310 may be spaced apart from an inner peripheral surface of the exhaust adapter 30 more than a lower part of the switch case 310. Accordingly, because the hinge part 340 provided at the upper part of the switch case 310 is spaced apart from the inner peripheral surface of the exhaust adapter 30, the hinge part 340 may be prevented from being damaged when the exhaust flue pipe 50 is inserted or separated.

Meanwhile, referring to FIGS. 5, 6, and 8, one end of the switch plate 320 may be hinge-coupled to the hinge part 340 included in the switch case 310, and an opposite end 323 of the switch plate 320 may extend downwards from the hinge part 340. That is, the switch plate 320 may extend in an upward/downward direction, the opposite end 323 of the switch plate 320 that is a free end, which contacts the exhaust flue pipe 50, may be located in the lower part of the switch plate 320.

Furthermore, the switch plate 320 may be inclined at angles of two steps.

In detail, the switch plate 320 may include a first inclined part 321 that extends from the one end in a direction that faces the opposite end 323 thereof, and is inclined toward an inside of the exhaust adapter 30 as it goes toward the opposite end 323, and a second inclined part 322 that extends from the first inclined part 321 in a direction that faces the opposite end 323, and is inclined toward the inside of the exhaust adapter 30 as it goes toward the opposite end 323.

Furthermore, the first inclined part 321 may be inclined at a first angle r1 with respect to a vertical reference surface RF that is perpendicular to the ground surface, and the second inclined part 322 may be inclined at a second angle r2 that is larger than the first angle r1 with respect to the vertical reference surface. Accordingly, the opposite end 323 of the switch plate 320, which is adjacent to the second inclined part 322, may be protrude further than when the entire of the switch plate 320 is formed at one angle.

In this way, because the switch plate 320 that extends downwards are inclined in two steps, not the entire switch plate 320 but the opposite end 323 of the switch plate 320 and the second inclined part 322 that is adjacent to the opposite end 323 may mainly contact the exhaust flue pipe 50. Accordingly, the present disclosure may cause the opposite end 323 to protrude further to detect the separation of the exhaust flue pipe 50 more accurately. Furthermore, at the same time, according to the present disclosure, damage to the hinge part 340 may be prevented more effectively when the exhaust flue pipe 50 is inserted, by decreasing a degree, by which the first inclined part 321 that is adjacent to the hinge part 340 contacts the exhaust flue pipe 50.

Meanwhile, the sensing switch 300 may further include a switch packing member 350. The switch packing member 350 may surround a circumference of the switch case 310 to seal a gap between the switch case 310 and the exhaust adapter 30 or a gap between the switch case 310 and the housing 200.

For example, the switch packing member 350 may have a rectangular frame shape having a hollow, and the switch case 310 of the sensing switch 300 may be inserted into the hollow. Then, an inner surface of the switch packing member 350 may be adhered to an outer surface of the switch case 310, and an outer surface of the switch packing member 350 may be adhered to the exhaust adapter 30 having the through-hole 31. Furthermore, the outer surface of the switch packing member 350 may be adhered to an inner surface of the first insertion part 213 of the housing body 210. The switch packing member 350 may be formed of a material that has elasticity and is robust to the condensate, and for example, may include a rubber material, but the present disclosure is not limited thereto.

The switch packing member 350 may prevent the condensate generated in the exhaust flue pipe 50 from being leaked to the outside through the through-hole 31. Furthermore, leakage of the exhaust gas in the interior of the exhaust adapter 30 to the outside may be minimized.

Meanwhile, the housing 200 may further include a first housing packing member 230. The first housing packing member 230 may be provided along a circumference of the through-hole 31 to seal a gap between the housing body 210 and the exhaust adapter 30, and may be interposed between the housing body 210 and the exhaust adapter 30.

For example, the first housing packing member 230 may have a rectangular frame shape having a hollow, and the first insertion part 213 of the housing body 210 may be inserted into the hollow of the first housing packing member 230. Then, the first housing packing member 230 may be adhered to the exhaust adapter 30 and the housing body 210. The first housing packing member 230 may be formed of a material that has elasticity and is robust to the condensate, and for example, may include a rubber material, but the present disclosure is not limited thereto.

The housing 200 may further include a second housing packing member 240. The second housing packing member 240 may be provided along a circumference of the connection hole, and may seal a gap between the housing body 210 and the boiler body 20. Then, the second housing packing member 240 may be adhered to the housing body 210 and the boiler body 20. The second housing packing member 240 may be formed of a material that has elasticity and is robust to the condensate, and for example, may include a rubber material, but the present disclosure is not limited thereto.

By the first housing packing member 230 and the second housing packing member 240, leakage of the exhaust gas in the interior of the exhaust adapter 30 to the outside may be minimized. Furthermore, leakage of the condensate in the interior of the exhaust flue pipe 50 to the outside may be minimized.

The flue pipe separation sensing apparatus and the boiler according to the present disclosure may prevent a safety accident due to the exhaust gas leaked between the exhaust flue pipe and the exhaust adapter in advance by detecting separation of the exhaust flue pipe from the exhaust adapter, and thus may enhance a reliability of the boiler product.

Furthermore, the sensing member according to the present disclosure proceeds into the interior of the exhaust adapter immediately after the exhaust flue pipe is separated to detect separation of the exhaust flue pipe, and thus may detect the separation of the exhaust flue pipe more accurately.

According to the present disclosure, leakage of the exhaust gas flowing in the interior of the exhaust adapter through the through-hole provided in the exhaust adapter and the condensate generated in the exhaust flue pipe to the outside may be minimized.

Although the specific embodiments of the present disclosure have been described until now, the spirit and scope of the present disclosure are not limited to the specific embodiments, and may be variously corrected and modified by an ordinary person in the art, to which the present disclosure pertains, without changing the essence of the present disclosure claimed in the claims.

What is claimed is:

1. A flue pipe separation sensing apparatus of a boiler for sensing separation of an exhaust flue pipe that is fitted with and coupled to an exhaust adapter provided in an exhaust opening of a boiler body, the flue pipe separation sensing apparatus comprising:

a sensing member located on an outer side of the exhaust flue pipe in a state, in which the exhaust flue pipe is coupled to the exhaust adapter, and configured to pass through the exhaust adapter by an elastic force and proceed into an interior of the exhaust adapter to sense the separation of the exhaust flue pipe when the exhaust flue pipe is separated from the exhaust adapter.

2. The flue pipe separation sensing apparatus of claim 1, wherein the exhaust adapter includes:

a through-hole that passes through a part, to which the exhaust flue pipe is coupled, and wherein the sensing member includes:

a sensing switch brought into any one of a contact-off state and a contact-on state in the state, in which the exhaust flue pipe is coupled to the exhaust adapter, and switched from the any one of the contact-off state and the contact-on state to the other of the contact-off state and the contact-on state to detect the separation of the exhaust flue pipe when the exhaust flue pipe is separated from the exhaust adapter.

3. The flue pipe separation sensing apparatus of claim 2, wherein the sensing switch includes:

a switch case;

a switch plate coupled to an outer surface of the switch case, and one end of which is hinge-coupled to the switch case and an opposite end of which is a free end, wherein the free end is configured to be inserted into the interior of the exhaust adapter through the through-hole; and a press part configured such that at least a portion thereof is inserted into and extracted from the switch case, and wherein the press part brings a contact point into any one of an off state and an on state by pressing the switch plate when the exhaust flue pipe is coupled to the exhaust adapter.

4. The flue pipe separation sensing apparatus of claim 3, wherein the press part protrudes to an outside of the switch case by a restoring force of an elastic member provided in an interior of the switch case to switch the contact point to the other of the off state and the on state by pressing the switch plate toward the interior of the exhaust adapter when the exhaust flue pipe is separated from the exhaust adapter.

5. The flue pipe separation sensing apparatus of claim 3, wherein the one end of the switch plate is hinge-coupled to a hinge part provided in the switch case, and the opposite end of the switch plate extends downwards from the hinge part.

6. The flue pipe separation sensing apparatus of claim 3, wherein the switch plate includes:

a first inclined part extending from the one end in a direction that faces the opposite direction, and inclined toward an inside of the exhaust adapter as it goes toward the opposite side; and a second inclined part extending from the first inclined part in a direction that faces the opposite direction, and inclined toward the inside of the exhaust adapter as it goes toward the opposite side, and wherein the first inclined part is inclined at a first angle with respect to a vertical reference surface that is perpendicular to a ground surface, and the second inclined part is inclined at a second angle that is larger than the first angle with respect to the vertical reference surface.

7. The flue pipe separation sensing apparatus of claim 3, wherein a surface of the switch case, which faces the inside of the exhaust adapter and on which the switch plate is mounted, is inclined in a direction that becomes farther away from the exhaust adapter as it goes upwards when the switch case is mounted on the exhaust adapter.

8. The flue pipe separation sensing apparatus of claim 3, further comprising:

a housing coupled to an outside of the exhaust adapter and configured to accommodate the sensing switch.

9. The flue pipe separation sensing apparatus of claim 8, wherein the housing includes:

a housing body coupled to the exhaust adapter and having an interior space, in which the sensing switch is accommodated;

a cover member coupled to an opening provided in the housing body and covering the interior space;

a first fastening member coupling the housing body and the exhaust adapter; and a second fastening member coupling the housing body and the cover member.

10. The flue pipe separation sensing apparatus of claim 9, wherein the sensing switch further includes:

a switch packing member configured to surround a circumference of the switch case to seal a gap between the switch case and the exhaust adapter or a gap between the switch case and the housing.

11. The flue pipe separation sensing apparatus of claim 10, wherein the housing further includes:

a first housing packing member provided along a circumference of the through-hole and interposed between the housing body and the exhaust adapter to seal a gap between the housing body and the exhaust adapter.

12. The flue pipe separation sensing apparatus of claim 10, wherein a connection hole, through which a wiring line electrically connected to the sensing switch passes, passes through the housing body, and wherein the housing further includes:

a second housing packing provided along a circumference of the connection hole and configured to seal a gap between the housing body and the boiler body.

13. A boiler comprising:

a boiler body;

an exhaust adapter provided in an exhaust opening opened in the boiler body and configured to discharge exhaust gas in an interior of the boiler body to an outside;

an exhaust flue pipe coupled to the exhaust adapter to be communicated with an interior of the exhaust adapter, and one end of which is inserted into the exhaust adapter; and a sensing apparatus provided in the exhaust adapter, and configured to sense separation of the exhaust flue pipe from the exhaust adapter, wherein the sensing apparatus includes a sensing member located on an outer side of the exhaust flue pipe in a state, in which the exhaust flue pipe is coupled to the exhaust adapter, and configured to pass through the exhaust adapter by an elastic force and proceed into the interior of the exhaust adapter to sense the separation of the exhaust flue pipe when the exhaust flue pipe is separated from the exhaust adapter.

14. The boiler of claim 13, wherein the exhaust adapter includes:

a through-hole that passes through a part, to which the exhaust flue pipe is coupled, and wherein the sensing member includes a sensing switch brought into any one of a contact-off state and a contact-on state in the state, in which the exhaust flue pipe is coupled to the exhaust adapter, and switched from the any one of the contact-off state and the contact-on state to the other of the contact-off state and the contact-on state to detect the separation of the exhaust flue pipe when the exhaust flue pipe is separated from the exhaust adapter.

15. The boiler of claim 14, wherein the exhaust adapter includes:

a switch mounting part including a hollow communicated with the through-hole, and extending to an outside of the exhaust adapter, and wherein a portion of a housing included in the sensing apparatus is inserted into the hollow of the switch mounting part.

* * * * *